US009183974B1

(12) United States Patent
Folker et al.

(10) Patent No.: US 9,183,974 B1
(45) Date of Patent: Nov. 10, 2015

(54) BOBBIN APPARATUS FOR REDUCING GAP LOSSES IN MAGNETIC COMPONENTS

(71) Applicants: Donald Folker, Madison, AL (US); Mike LeBlanc, Huntsville, AL (US); Brandon Dyer, Madison, AL (US)

(72) Inventors: Donald Folker, Madison, AL (US); Mike LeBlanc, Huntsville, AL (US); Brandon Dyer, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 13/953,413

(22) Filed: Jul. 29, 2013

Related U.S. Application Data

(60) Provisional application No. 61/680,336, filed on Aug. 7, 2012.

(51) Int. Cl.

| | |
|---|---|
| ***H01F 17/06*** | (2006.01) |
| ***H01F 27/30*** | (2006.01) |
| ***H01F 27/24*** | (2006.01) |
| ***H01F 5/02*** | (2006.01) |

(52) U.S. Cl.
CPC ..... *H01F 5/02* (2013.01)

(58) Field of Classification Search
CPC ..... H01F 27/325; H01F 27/324; H01F 3/14; H01F 5/02
USPC ..... 336/212, 178, 198, 208, 170
See application file for complete search history.

(56) References Cited

U.S. PATENT DOCUMENTS

| | | | | |
|---|---|---|---|---|
| 8,212,643 | B1 * | 7/2012 | Folker et al. | 336/198 |
| 2007/0075821 | A1 * | 4/2007 | Hsueh et al. | 336/221 |

* cited by examiner

*Primary Examiner* — Mangtin Lian
(74) *Attorney, Agent, or Firm* — Patterson Intellectual Property Law, P.C.; Mark J. Patterson; Jerry Turner Sewell

(57) ABSTRACT

A bobbin apparatus and associated magnetic component is configured to reduce gap losses associated with a core air gap in a bobbin-wound magnetic component such as an inductor or transformer. The bobbin includes a step structure protruding from the winding surface between bobbin ends. The step is operable to provide spacing between the conductive windings disposed on the bobbin and the core air gap inside the bobbin axial passage. The spacing reduces stray flux interactions with the conductive winding, thereby reducing gap losses and preventing undesirable heating of the winding and core. Additional winding configurations and methods for use with the bobbin apparatus are also provided.

15 Claims, 8 Drawing Sheets

BOBBIN APPARATUS FOR REDUCING GAP LOSSES IN MAGNETIC COMPONENTS

CROSS-REFERENCES TO RELATED APPLICATIONS

This application claims benefit of the following patent application which is hereby incorporated by reference in its entirety: Method And Apparatus For Reducing Gap Losses In Magnetic Components, Ser. No. 61/680,336 Filed Aug. 7, 2012

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic components for electronic circuits, and more particularly to bobbin and core structures for reducing gap losses in magnetic components such as inductors and transformers.

Conventional magnetic components such as inductors and transformers generally include a bobbin about which one or more conductive windings are placed. One or more magnetically permeable core members are also generally placed on or near the bobbin such that a magnetic field interaction is achieved between the core members and the conductive winding. In many applications, the core members are positioned such that a gap is defined between the core members at a location inside the bobbin structure. Air gaps may be provided for a variety of reasons, such as to influence magnetic or electrical performance of the magnetic component.

One problem associated with bobbin-wound magnetic components having a core air gap is leakage inductance. Leakage inductance results in local stray magnetic flux that may adversely affect performance of the magnetic component. In magnetic components having conventional bobbin and core structure configurations, stray flux associated with leakage inductance across a core air gap may interact with local regions of the conductive coil, leading to undesirable eddy currents. Stray flux interaction with the conductive coil may also cause an undesirable temperature rise in the coil, further reducing performance. Such interactions also cause eddy losses and reduce performance of the component.

Others have attempted to overcome the problems associated with stray flux by changing winding patterns or air gap dimensions, but such approaches are generally inadequate.

What is needed then are improvements in magnetic components and associated bobbin and core structures to reduce gap losses and other undesirable effects associated with stray flux near core air gaps.

BRIEF SUMMARY OF THE INVENTION

The present invention provides a magnetic component and related bobbin and core structures, and associated winding configurations and methods, for reducing gap losses and other undesirable effects associated with air gaps in devices such as inductors and transformers.

In some embodiments, the present invention provides a bobbin apparatus for supporting a core assembly, the core assembly defining a gap having an axial gap distance. The bobbin apparatus includes a bobbin body having a first bobbin end and a second bobbin end spaced from the first bobbin end. An axial passage is defined through the bobbin body between the first and second bobbin ends. The bobbin body includes an inner passage surface substantially facing the axial passage. A winding surface is disposed on the bobbin body between the first and second bobbin ends. A step having an outer step surface protrudes from the winding surface between the first and second bobbin ends. The step has a step height defined as the distance between the local inner passage surface and the local outer step surface. The step height is equal to or greater than the axial gap distance.

In further embodiments, the present invention provides a magnetic component apparatus for use in an electronic circuit. The apparatus includes a bobbin body having a first bobbin end and a second bobbin end spaced from the first bobbin end. The bobbin body includes a winding surface between the first and second bobbin ends. An axial passage is defined through the bobbin body between the first and second bobbin ends. The bobbin body includes an inner passage surface substantially facing the axial passage. A first core member is positioned at least partially in the axial passage, and a second core member is positioned at least partially in the axial passage. An axial air gap is defined between the first and second core members in the axial passage. The air gap has an axial gap distance. A step having an outer step surface protrudes from the winding surface between the first and second bobbin ends. The step has a step height defined as the distance between the inner passage surface and the outer step surface. The step height is equal to or greater than the axial gap distance.

Another embodiment of the present invention provides a bobbin apparatus for supporting a core assembly, the core assembly defining an air gap having an axial gap distance. The apparatus includes a bobbin body having a first bobbin end and a second bobbin end spaced from the first bobbin end. An axial passage is defined through the bobbin body between the first and second bobbin ends. The bobbin body includes an inner passage surface substantially facing the axial passage. A winding surface is disposed on the bobbin body between the first and second bobbin ends. A step having an outer step surface protrudes from the winding surface between the first and second bobbin ends. The step has an axial width defined as the width of the step in the longitudinal direction between first and second bobbin ends. The axial width is equal to or greater than twice the axial gap distance.

A further object of the present invention is to provide a bobbin apparatus for reducing gap losses associated with stray flux interactions in an air-gap bobbin wound magnetic component.

Yet another object of the present invention is to provide a bobbin apparatus including a step structure in the winding region to separate the conductive windings from the air gap inside the bobbin axial passage.

Another object of the present invention is to provide a bobbin apparatus with a step having an optimized height to reduce stray flux interactions with conductive winding layers positioned on the bobbin.

Another object of the present invention is to provide a bobbin apparatus with a step having an optimized axial width to reduce stray flux interactions with conductive winding layers positioned on the bobbin.

A further object of the present invention is to provide a bobbin apparatus with a step having an optimized step height and an optimized axial width to reduce stray flux interactions with conductive winding layers positioned on the bobbin.

Yet another object of the present invention is to provide a magnetic component having a bobbin, air gap core assembly and conductive windings, wherein the step includes step height and axial width dimensions to reduce stray flux interactions between the conductive windings and the air gap core assembly.

Numerous other objects, features and advantages of the present invention will be readily apparent to those skilled in the art upon a reading of the following disclosure when taken in conjunction with the accompanying drawings.

DETAILED DESCRIPTION

Figure 1:
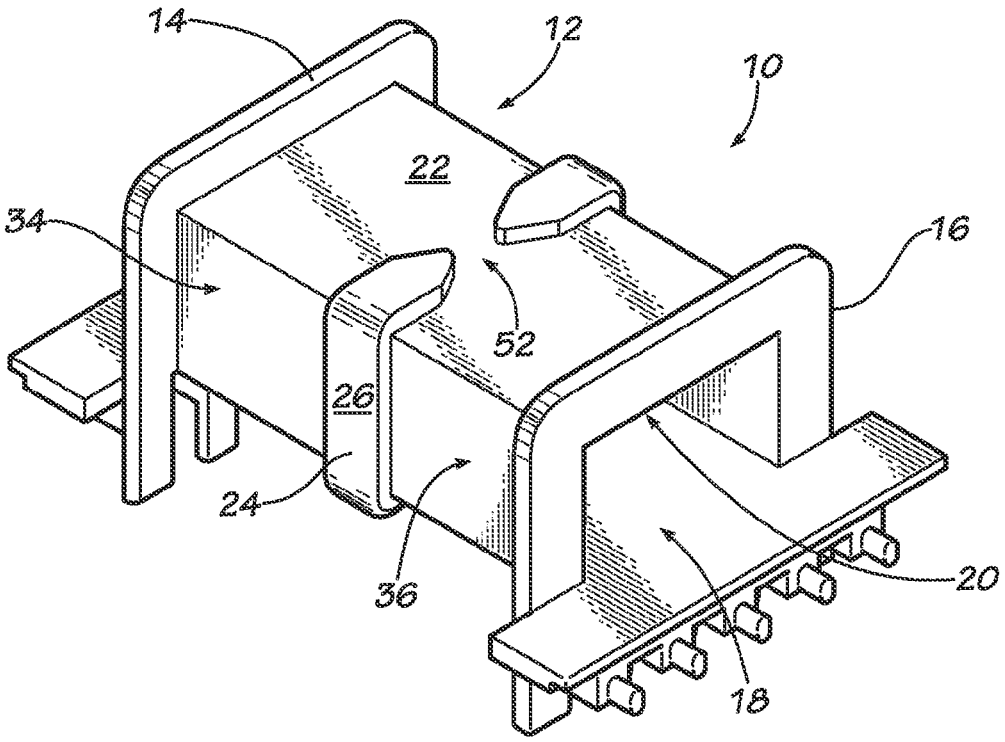
FIG. 1 illustrates a perspective view of an embodiment of a bobbin apparatus for a magnetic component.

Referring now to the drawings, FIG. 1 illustrates an embodiment of a bobbin apparatus designated by the numeral 10. Bobbin apparatus 10 includes a bobbin body 12 having a first bobbin end 14 and a second bobbin end 16. First and second bobbin ends 14, 16 are spaced from each other at opposite longitudinal ends of bobbin 10. Each bobbin end may include a flange protruding from bobbin body 10. A winding surface 22 is defined on bobbin 10 between first and second bobbin ends 14, 16. Winding surface 22 is an outer surface of bobbin 10 upon which a one or more turns of conductive material such as a conductive wire may be placed. As such, bobbin 10 provides a structure for winding one or more turns of conductive wire for forming a magnetic component such as a bobbin-wound inductor or transformer.

Bobbin 10 includes an axial passage 18 defined longitudinally through the bobbin body 10 between the first and second bobbin ends 14, 16. Axial passage 18 forms a clearance void through the interior of the bobbin body 12. Axial passage 18 may be integrally formed on bobbin body 12 during a casting or molding process in some embodiments. Axial passage 18 is generally dimensioned and shaped to accommodate one or more magnetically permeable core structures. Axial passage 18 extends axially, or longitudinally, through the bobbin body in a generally linear fashion in some embodiments. An inner passage surface 20 is defined on the interior wall of the bobbin body facing the axial passage 18. Axial passage 18 is surrounded by inner passage surface 20.

Figure 2:
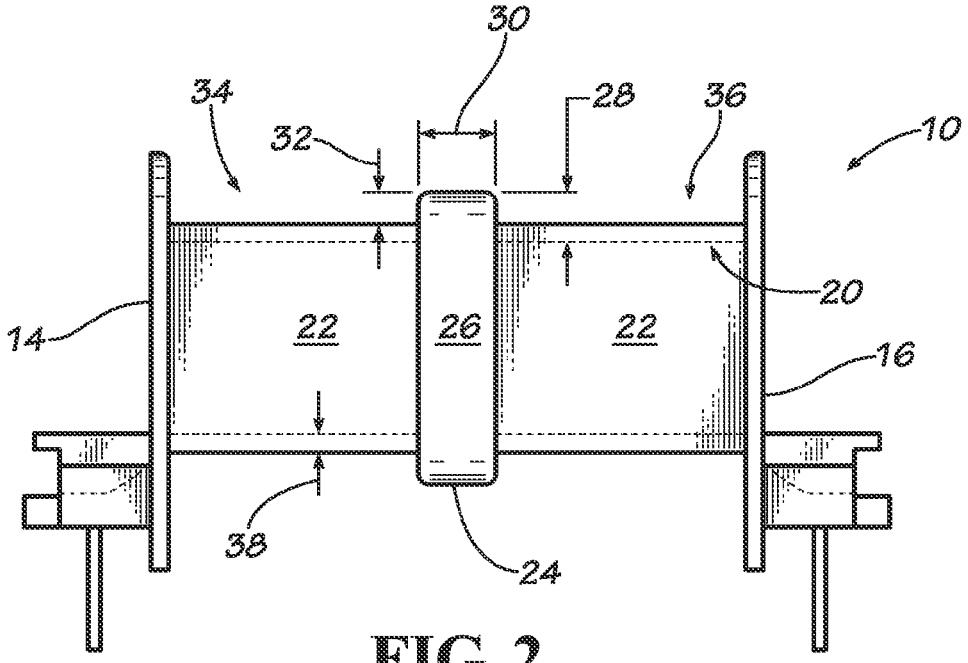
FIG. 2 illustrates a side view of the embodiment of a bobbin apparatus of FIG. 1.

As seen in FIG. 1 and FIG. 2, bobbin 10 may include one or more end supports for mounting electrical terminals such as pin connectors, plugs, terminal jacks, or any other suitable electrical connectors. Bobbin 10 also includes one or more mechanical standoff structures located on the first and second end supports to provide a mechanical engagement with a substrate such as a circuit board upon which bobbin 10 may be mounted. Bobbin 10 in some embodiments is configured to be surface-mounted on a printed circuit board.

Referring further to FIGS. 1-4, bobbin 10 includes a step 24 having an outer step surface 26 protruding from winding surface 22. Step 24 is integrally formed on bobbin 10 in a unitary one-piece construction in some embodiments. Step 24 may be formed on bobbin 10 in an injection molding procedure in some embodiments. In other embodiments, step 24 is a separate part that is snapped onto or otherwise installed on a bobbin winding surface 22. Step 24 provides a raised portion extending upwardly from the winding surface 22. Step 24 in some embodiments divides winding surface 22 into a first winding region 34 and a second winding region 36. Step 24 includes a step height 28, seen in FIG. 2. Step height 28 is generally defined as the distance between local outer step surface 26 and local inner passage surface 20, as shown in FIG. 2. Step height 28 provides the local distance the step 24 is raised above the local inner passage surface 20 on the interior of axial passage 18. When a core structure is positioned inside axial passage 18 such that the core structure engages the inner wall or inner passage surface 20 of the axial passage, the step height 28 provides a measure of the minimum distance from the local core structure surface to the local outermost step surface 26.

Figure 5:
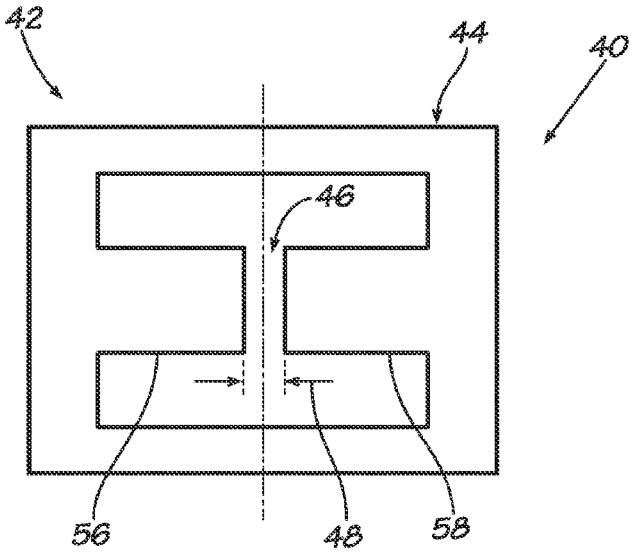
FIG. 5 illustrates a top view of an embodiment of a core assembly for use with the bobbin apparatus of FIG. 1.
Figure 6:
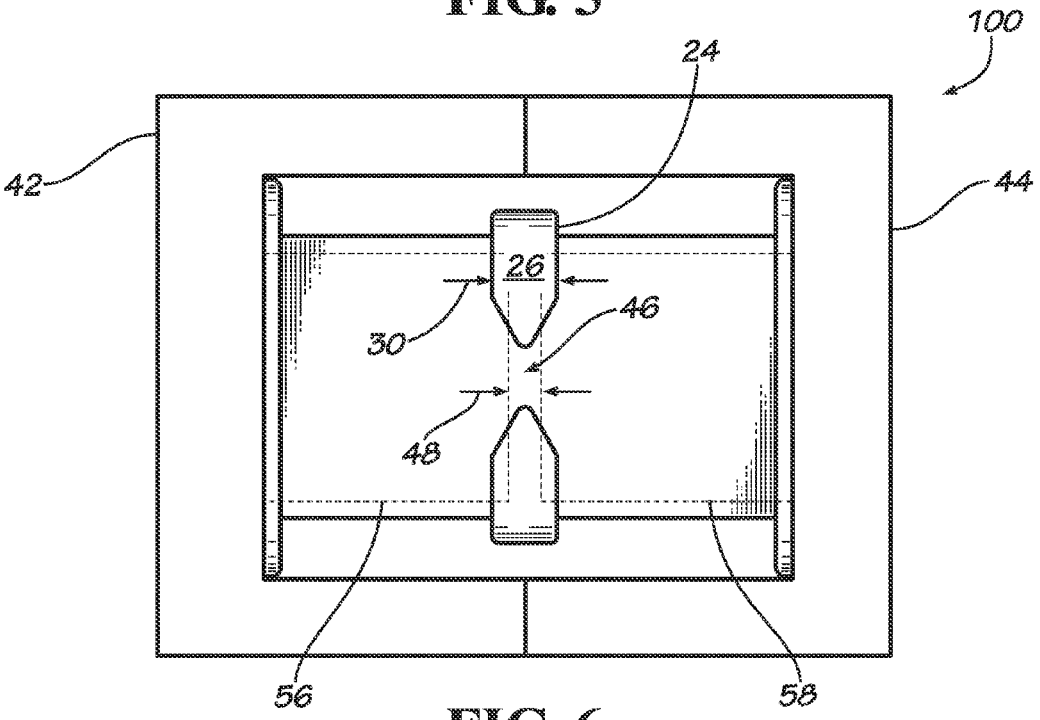
FIG. 6 illustrates a top view of an embodiment of a magnetic component including a bobbin apparatus and a core assembly.

In some embodiments, bobbin 10 is configured for use with a core assembly including at least one magnetically permeable core material such as ferrite. A core assembly 40 may be positioned on bobbin 10 such that a portion of the core assembly protrudes into the axial passage 18. A core assembly 40 may include one or more core structures, or core pieces. For example, as shown in FIG. 5, an embodiment of a core assembly 40 for use with bobbin 10 includes a first core member 42 and a second core member 44. First core member 42 and second core member 44 each form an E-core in some embodiments. In other embodiments, one of first and second core members is an E-core, and the other core member is a different type of core member such as a bar or I-core. As shown in FIG. 6, first and second core members 42, 44 are positioned opposite each other such that the first middle core leg 56 on first core member 42 protrudes toward second middle core leg 58 on second core member 44.

Figure 18:
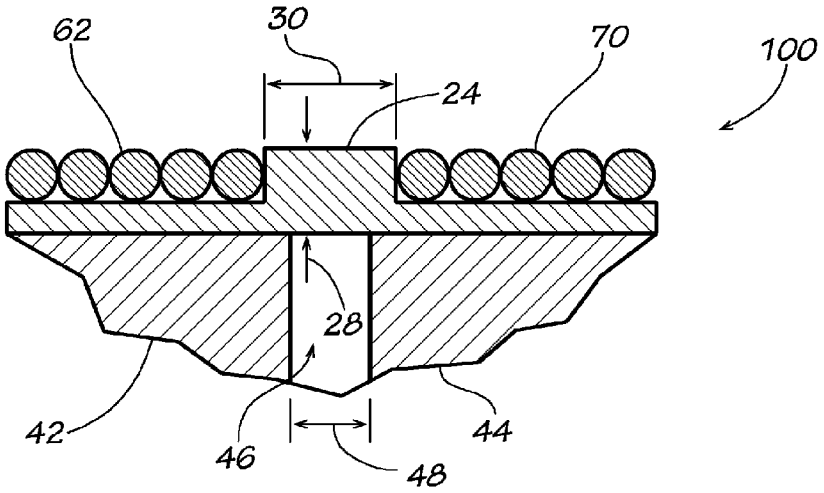
FIG. 18 illustrates a partial cross-sectional view of an embodiment of a magnetic component including a bobbin, conductive winding and core assembly.

Referring to FIG. 6, first and second core members 42, 44 are shown positioned on bobbin 10 to form a magnetic component 100. First and second core members 42, 44 are E-cores in this embodiment, and each core member has a middle core leg 56, 58 protruding into axial passage 18. An air gap 46 is defined between the distal ends of first and second middle core legs 56, 58 inside axial passage 18. The air gap 46 is located at a midpoint between first and second bobbin ends 14, 16 in other embodiments. In alternative embodiments, the air gap 46 may be located nearer first or second bobbin end 14, 16. Bobbin 10 is configured such that step 24 is axially aligned with air gap 46 when first and second core members 42, 44 are located in axial passage 18. Centering of the step 24 over the air gap 46 provides a desired effect of preventing stray flux associated with the air gap 46 from interacting with a conductive winding positioned on the bobbin. For example, as seen in FIG. 18, air gap 46 is longitudinally aligned with step 24, and step 24 prevents first and second winding 62, 70 from being wound directly over the air gap 46. Separation of winding from the air gap 46 via step 24 reduces the interaction of stray flux with the winding 46 near the air gap 46, and correspondingly reduces gap losses in the magnetic component 100.

Referring further to FIG. 2, step 24 also includes an axial width 30 defined as the dimension of the step 24 in the longitudinal, or axial direction, on bobbin 10. Axial width 30 is the width of step 24 in the longitudinal direction of bobbin 10 between first and second bobbin ends 14, 16. In some embodiments, step 24 includes an axial width 30 substantially equal to two times the axial gap distance 48 or greater than two times the axial gap distance 48. Providing an axial width 30 equal to two times the axial gap distance 48 or greater than twice the axial gap distances 48 allows the conductive coil of a winding positioned on bobbin 10 to be spaced from the air gap 46 to reduce the interaction between the winding and stray flux associated with the air gap 46 in some embodiments. In some applications, reduction of gap losses may be achieved by providing both (1) an axial width 30 equal to twice axial gap distance 48 or greater than twice axial gap distance 48 of air gap 46, and (2) a step height 28 equal to or greater than axial gap distance 48. A step 24 having these combined dimensions may further reduce gap losses and provide improved performance and lower heating of the conductive coil by reducing stray flux interaction with the conductive windings positioned on the bobbin. Additionally, the reduction of gap losses provided by step 24 may allow magnetic component size to be reduced, further reducing material costs and overall device footprint.

Figure 7:
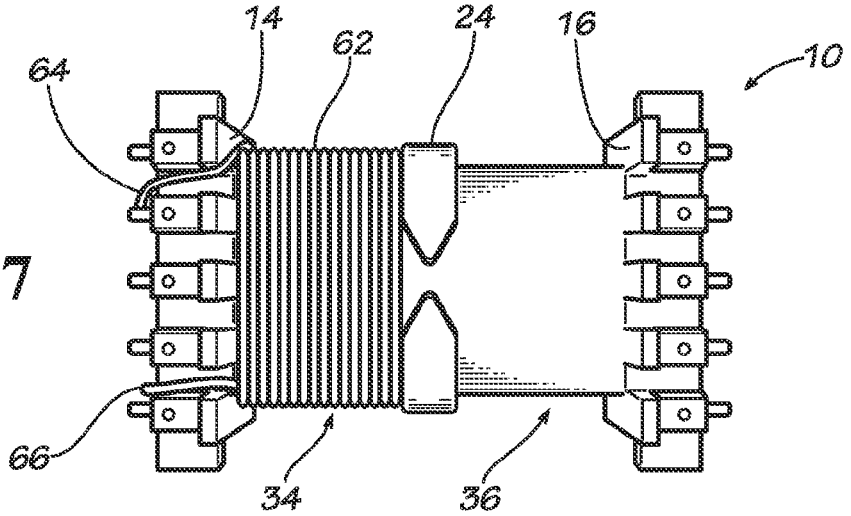
FIG. 7 illustrates a bottom view of an embodiment of a bobbin apparatus with a first conductive coil partially wound thereon.
Figure 8:
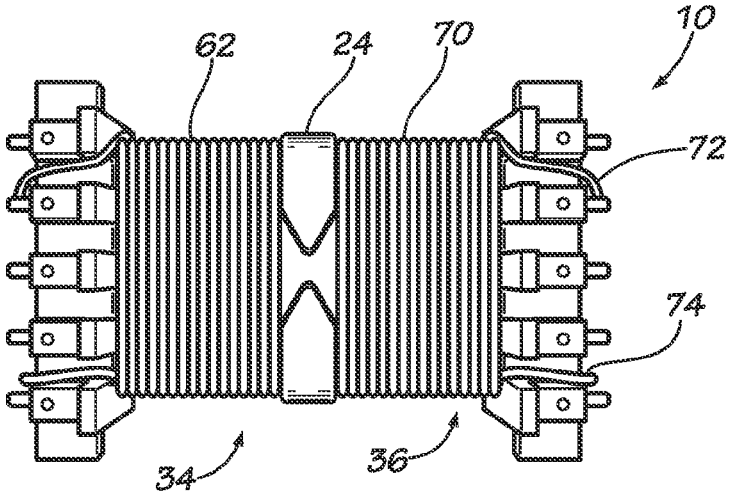
FIG. 8 illustrates a bottom view of the embodiment of a bobbin apparatus of FIG. 7 with first and second conductive coils partially wound thereon.
Figure 9:
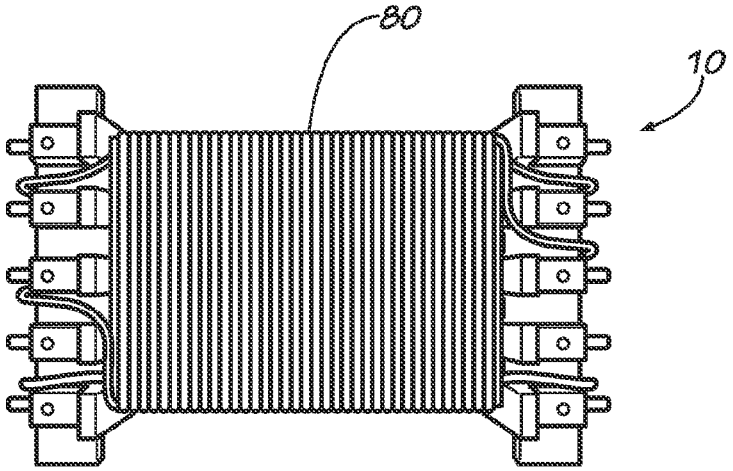
FIG. 9 illustrates a bottom view of the embodiment of a bobbin apparatus of FIG. 8 with first, second and third conductive coils partially wound thereon.

Additionally, the present invention provides winding configurations that allow a conductive winding such as a conductive wire to be wound about bobbin 10 to achieve desired performance characteristics. A first winding configuration is shown generally in FIGS. 7-9. The first winding configuration provides placement of a first conductive winding 62 about bobbin 10 in the first winding region 34. First conductive winding 62 includes a first winding first end 64 and a first winding second end 66 each exiting the first winding region 34 in the axial direction away from the second bobbin end. First conductive winding 62 is positioned against the winding surface between step 24 and first bobbin end 14. As seen in FIG. 8, a second conductive winding 70 is located in the second winding region 36 between step 24 and second bobbin end 16. Second conductive winding 70 includes a plurality of turns of conductive wire positioned around the bobbin 10. Second conductive winding 70 also includes second winding first end 72 and second winding second end 74 protruding axially from the second winding region 36 in the axial direction away from the first bobbin end 14. A winding method associated with this configuration includes multiple steps. First, the first conductive winding 62 is wound on the first winding region 34 between first bobbin end 14 and step 24. Second conductive winding 70 is then wound in the second winding region 36 between second bobbin end 16 and step 24. After the first and second conductive windings 62, 70 are positioned on bobbin 10 in first and second winding regions 34, 36 respectively, the windings form a single wire layer around the bobbin, having a wire height near the distance the step protrudes above the winding surface, as shown in the cross-sectional view in FIG. 18. As seen in FIG. 9, a third conductive winding 80 is then wound over the first and second conductive windings 62, 70 across the entire length of the bobbin between first and second bobbin ends 14, 16. Third conductive winding 80 covers first and second windings 62, 70 and also covers step 24, as seen in FIG. 9. The first and second windings 62, 70 and the step 24 provide a substantially even base, as shown in FIG. 18, for winding the third conductive winding 80 shown in FIG. 9. Each conductive winding 62, 70, 80 is then electrically interconnected to form a continuous winding. The windings may be interconnected in series or in parallel, or in a combination, in some embodiments.

Figure 3:
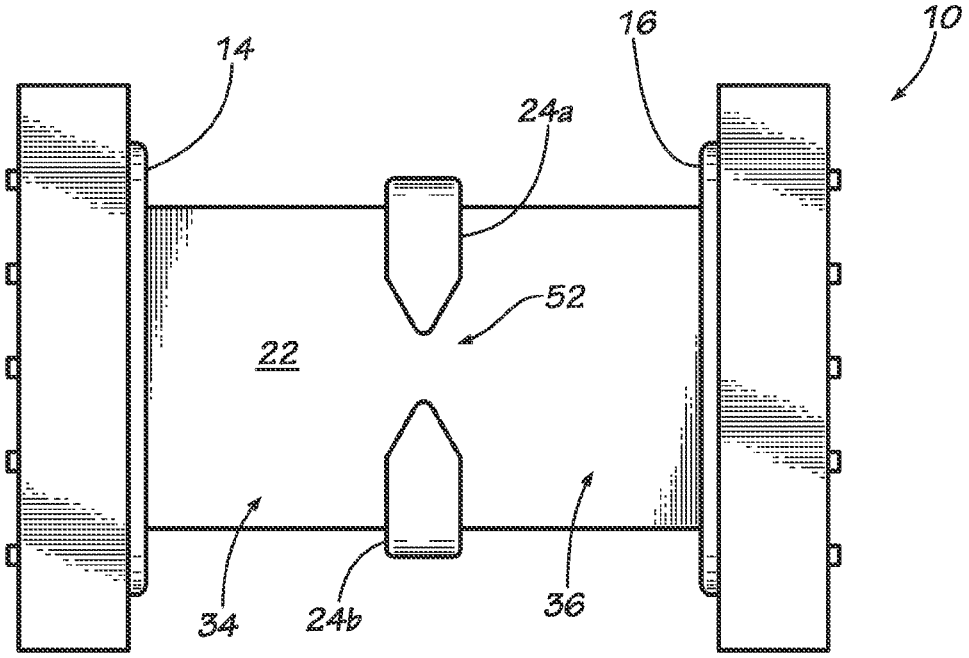
FIG. 3 illustrates a top view of the embodiment of a bobbin apparatus of FIG. 1.
Figure 4:
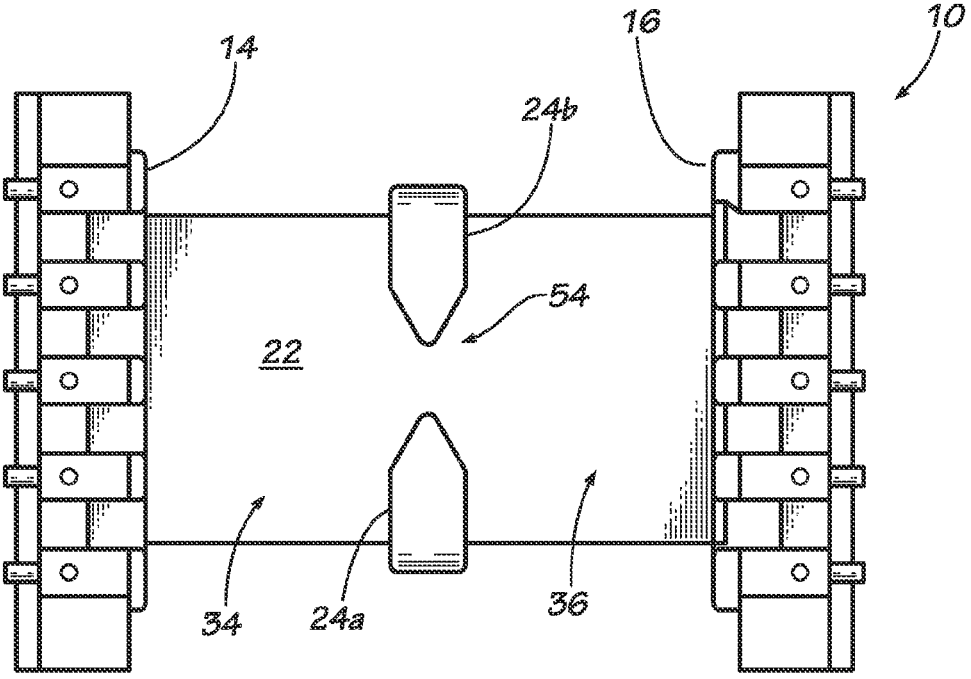
FIG. 4 illustrates a bottom view of the embodiment of a bobbin apparatus of FIG. 1.
Figure 10:
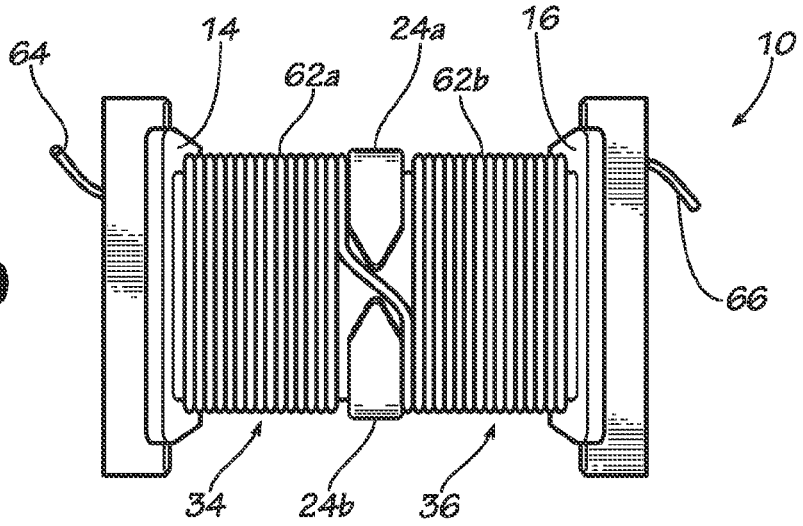
FIG. 10 illustrates a top view of an embodiment of a bobbin apparatus with a first conductive coil partially wound thereon in a first winding layer.
Figure 11:
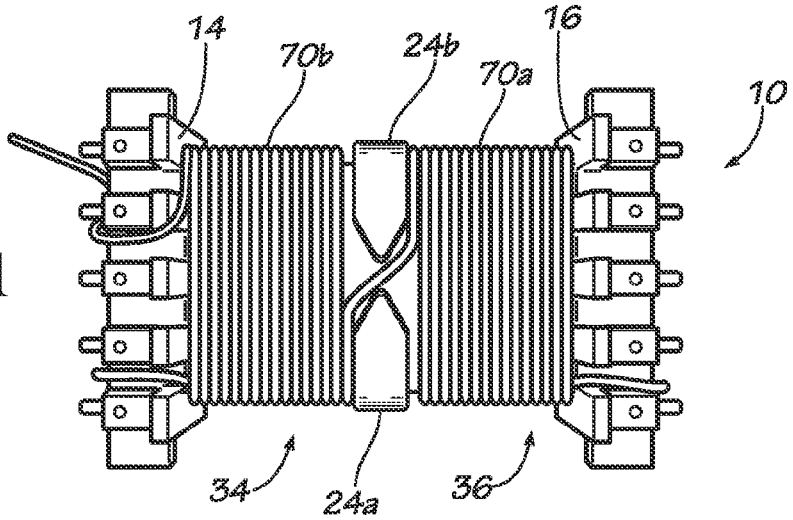
FIG. 11 illustrates a bottom view of the embodiment of a bobbin apparatus of FIG. 10 with a first conductive coil partially wound thereon in first and second winding layers.
Figure 12:
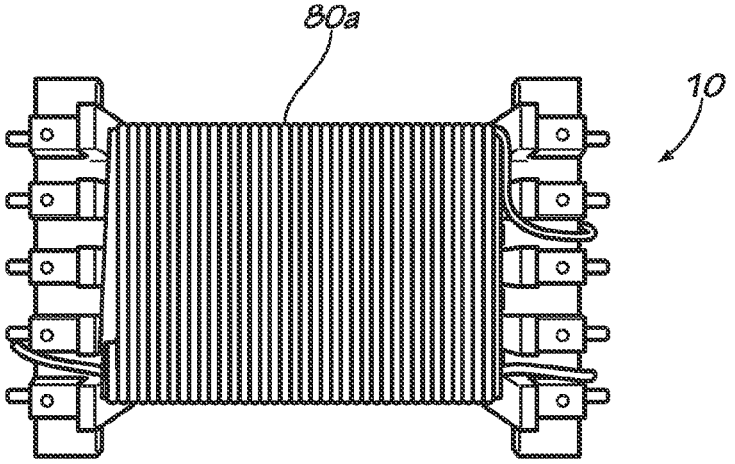
FIG. 12 illustrates a bottom view of the embodiment of a bobbin apparatus of FIG. 11 with a first conductive coil partially wound thereon in first, second and third winding layers.
Figure 19:
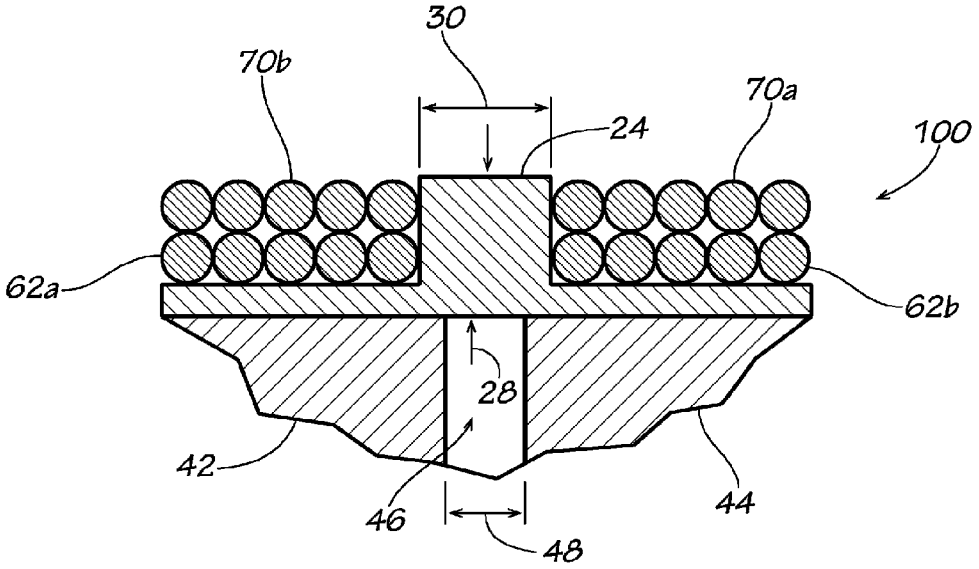
FIG. 19 illustrates a partial cross-sectional view of an embodiment of a magnetic component including a bobbin, conductive winding and core assembly.

A second winding configuration is generally shown in FIGS. 10-12. In these embodiments, bobbin 10 includes a step having a first step segment 24*a* and a second step segment 24*b*. The step includes a first step recess 52 defined in the step on a first surface, or top surface, of the bobbin 10, as seen in FIG. 3. The step also includes a second step recess 54 formed in the step on the side opposite the first step recess 52. The second step recess 54 is formed on the bottom surface as shown in FIG. 4 in some embodiments. Each step recess includes a tapered converging-diverging recess profile, as seen in FIG. 1. This allows a wire to be passed between winding regions at an angle without kinking or bending the wire past about a 45-degree angle in some embodiments, as seen in FIGS. 10 and 11. Because step 24 includes opposing step recesses 52, 54, step 24 is divided into two segments, a first step segment 24*a* and a second step segment 24*b*. In other embodiments, step 24 includes only one step recess, and step 24 is otherwise continuous around the perimeter of bobbin 10. As seen in FIG. 10, in some embodiments the present invention provides a method of winding a bobbin and an associated bobbin winding configuration. The method includes a step of positioning a first conductive winding portion 62*a* in first winding region 34 on bobbin 10. The first conductive winding portion 62*a* is located between step 24 and first bobbin end 14. A portion of the wire forming first conductive winding portion 62*a* is passed through first step recess 52 into second winding region 36, and the wire is then wound about bobbin 10 in second winding region between step 24 and second bobbin end 16. The first and second portions of the conductive winding form a first winding layer, as seen in FIG. 10. A second layer of the conductive winding is then wound over the first winding layer. The second layer includes a second conductive winding layer 70*a* beginning at second bobbin end 16 and winding toward step 24 over second conductive winding portion 62*b*. A portion of the second conductive winding layer passes through second step recess 54 into first winding region 34. The second conductive winding layer 70*b* is then wound over first conductive winding portion 62*a* in first winding region 34, as shown in FIG. 11 and as shown in FIG. 19. After the second winding layer has been wound over the first winding layer, the height of the combined first and second winding layers is substantially equal to the height of the first and second step segments 24*a*, 24*b* above the winding surface 22. As such, the outer step surface 26 is substantially even with the outer level of the second winding layer, as seen in FIG. 19, forming an even base for positioning a third winding layer 80*a*, as seen in FIG. 12. In some embodiments, the outer step surface 26 is substantially flat, providing a smooth surface for positioning a winding layer thereon. Referring to FIG. 12, the third winding layer 80*a* extends over first and second regions of second winding layer 70*a*, 70*b* and also over first and second step segments 24*a*, 24*b* between first and second bobbin ends 14, 16. In some embodiments, first, second and third winding layers are one continuous piece of wire wound across the bobbin three times, alternating directions twice. Alternatively, the separate winding layers are individual wires wound at the appropriate locations and subsequently electrically interconnected to form a continuous winding. In other embodiments, two of first and second winding layers are a single continuous wire and the third is a separate wire.

Referring now to FIGS. 13-17, an alternative embodiment of a bobbin 10 is shown. Bobbin 10 includes a step 24 having a first step flange 25*a* protruding outwardly from the step 24 on the side of the step 24 facing first bobbin end 14. Step 24 also includes a second step flange 25*b* protruding outwardly from the step 24 on the side of the step 24 facing second bobbin end 16. First and second step flanges 25*a*, 25*b* provide a space therebetween above outer step surface 26 for positioning an additional conductive winding. One or both step flanges include a step flange recess for allowing the passage of one or more conductive wires associated with a winding positioned between the step flanges. In this embodiment, step 24 includes a step height equal to or greater than the axial gap distance 46 on core assembly 40. Additionally, step 24 includes an axial width equal to or greater than twice the axial gap distance 46 on core assembly 40 in some embodiments.

Figure 13:
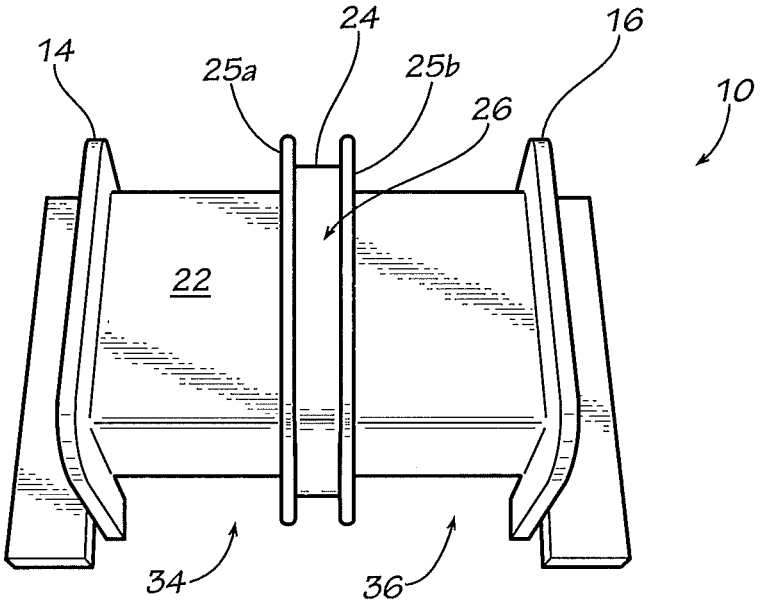
FIG. 13 illustrates a top perspective view of an embodiment of a bobbin apparatus.
Figure 14:
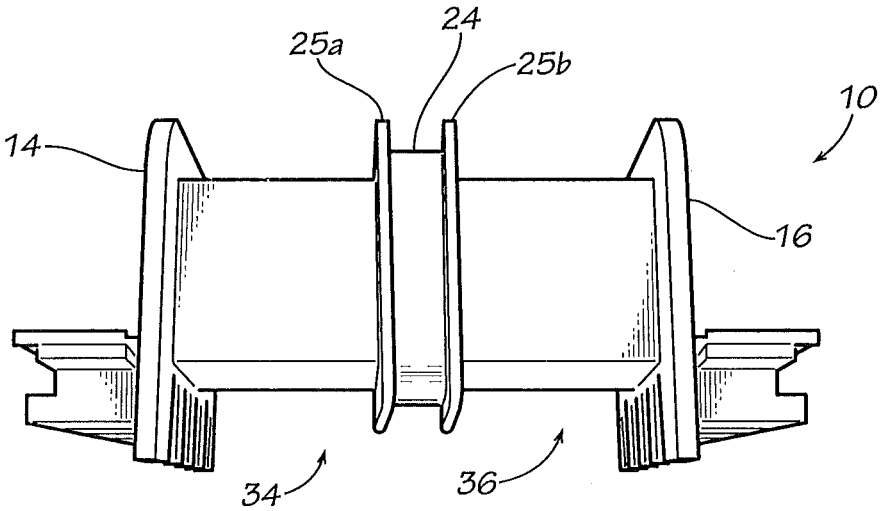
FIG. 14 illustrates a side perspective view of the embodiment of a bobbin apparatus of FIG. 13.
Figure 15:
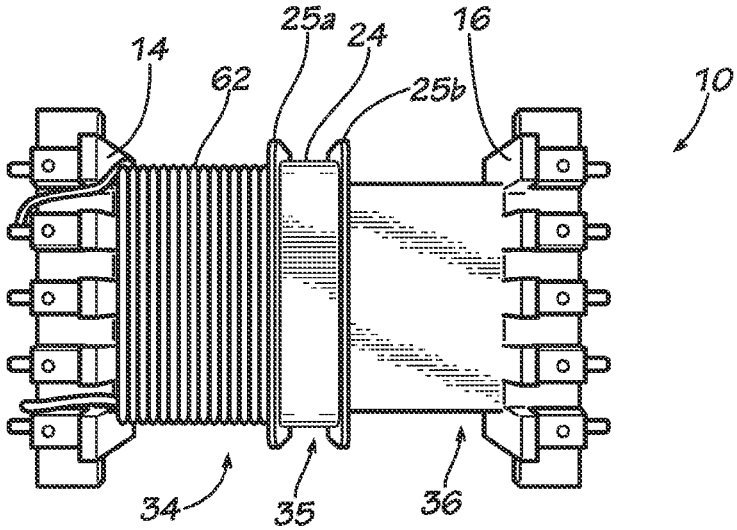
FIG. 15 illustrates a bottom view of the bobbin apparatus of FIG. 13 with a first conductive coil partially wound thereon.
Figure 16:
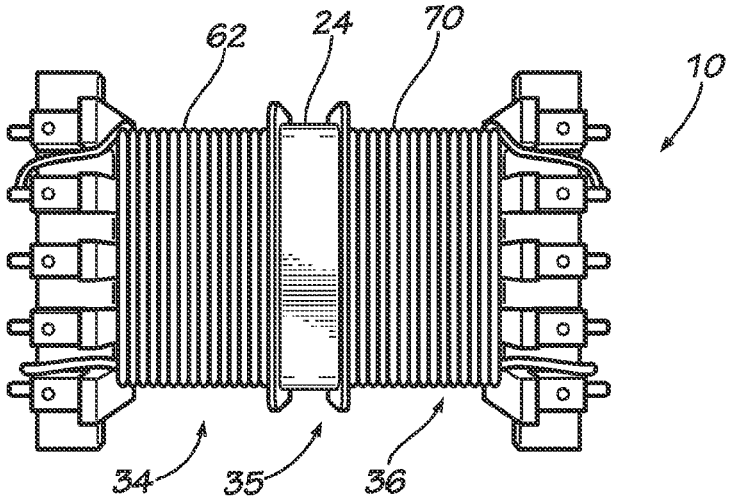
FIG. 16 illustrates a bottom view of the bobbin apparatus of FIG. 13 with first and second conductive coils partially wound thereon.
Figure 17:
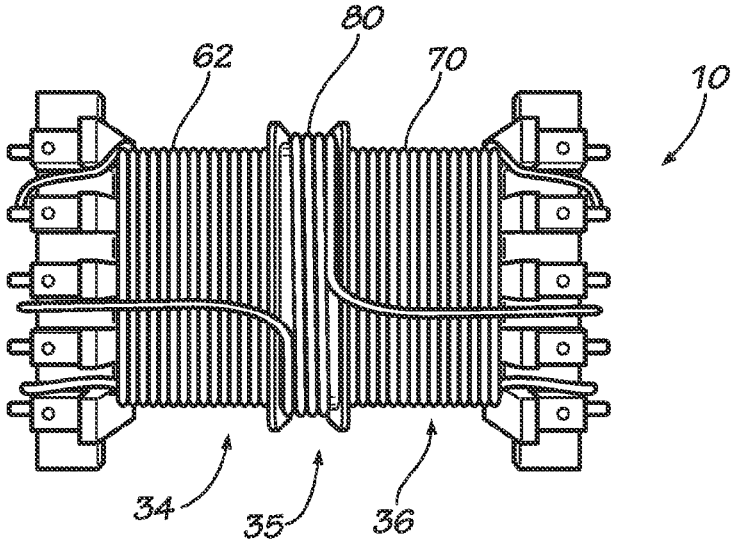
FIG. 17 illustrates a bottom view of the bobbin apparatus of FIG. 13 with first, second and third conductive coils wound thereon.

Referring now to FIGS. 15-17, an alternative winding configuration and method is generally illustrated for the modified bobbin 10 seen in FIGS. 13-14. In this configuration, a first conductive winding 62 is positioned about bobbin 10 in first winding region 34 between first bobbin end 14 and step 24. A second conductive winding 70 is then positioned about bobbin 10 in second winding region 36 between step 24 and second bobbin end 16. A third conductive winding 80 is then positioned about step 24 in a third winding region 35 between first and second step flanges 25*a*, 25*b*. Third winding region 35 is defined about the outer step surface 25 (FIG. 13) on step 24. Third conductive winding 80 includes a fewer number of turns about bobbin 10 than first conductive winding 62 or second conductive winding 70. The first, second and third conductive windings 62, 70, 80 are electrically interconnected start to finish to form one continuous winding. The three conductive windings are interconnected in series in some embodiments. In alternative embodiments, the windings are interconnected in parallel.

The winding configurations may be used with bobbin 10 to further improve performance and reduce gap losses for a magnetic component. In other embodiments, bobbin 10 may be used with other suitable winding configurations and methods not shown.

Thus, although there have been described particular embodiments of the present invention of a new and useful Bobbin Apparatus for Reducing Gap Losses in Magnetic Components it is not intended that such references be construed as limitations upon the scope of this invention except as set forth in the following claims.

What is claimed is:

1. A bobbin apparatus for supporting a core assembly, the core assembly including an air gap having an axial gap distance, the bobbin apparatus comprising:

a bobbin body having a first bobbin end and a second bobbin end, the second bobbin end spaced from the first bobbin end;

an axial passage defined through the bobbin body between the first and second bobbin ends, the bobbin body including an inner passage surface substantially facing the axial passage, the core assembly insertable into the axial passage with the air gap of the core assembly located at an air gap position between the first and second bobbin ends;

a winding surface disposed on the bobbin body between the first and second bobbin ends; and a step having an outer step surface protruding from the winding surface between the first and second bobbin ends, the step located on the winding surface in substantial alignment with the air gap position, the step having a step height defined as the distance between the inner passage surface and the outer step surface, wherein the step height is at least as great as the axial gap distance, wherein the step further comprises an axial step width at least as great as twice the axial gap distance.

2. The apparatus of claim 1, wherein the step height is substantially equal to the axial gap distance.

3. The apparatus of claim 1, wherein the step height is within about ten percent of the axial gap distance.

4. The apparatus of claim 1, wherein the step is located at an axial midpoint between the first and second bobbin ends.

5. The apparatus of claim 1, wherein the step is integrally molded on the bobbin body.

6. A bobbin apparatus for supporting a core assembly, the core assembly including an air gap having an axial gap distance, the bobbin apparatus comprising:

a bobbin body having a first bobbin end and a second bobbin end, the second bobbin end spaced from the first bobbin end;

an axial passage defined through the bobbin body between the first and second bobbin ends, the bobbin body including an inner passage surface substantially facing the axial passage, the core assembly insertable into the axial passage with the air gap of the core assembly located at an air gap position between the first and second bobbin ends;

a winding surface disposed on the bobbin body between the first and second bobbin ends; and a step having an outer step surface protruding from the winding surface between the first and second bobbin ends, the step located on the winding surface in substantial alignment with the air gap position, the step having a step height defined as the distance between the inner passage surface and the outer step surface, wherein the step height is at least as great as the axial gap distance, wherein the step further comprises an axial width substantially equal to twice the axial gap distance.

7. The apparatus of claim 6, wherein the step height is substantially equal to the axial gap distance.

8. The apparatus of claim 7, wherein the step divides the winding region into a first winding region between the step and the first bobbin end and a second winding region between the step and the second bobbin end.

9. The apparatus of claim 8, further comprising a wire passage recess defined in the step, the wire passage recess providing a passage for routing a wire from the first winding region to the second winding region.

10. A magnetic component apparatus for use in an electronic circuit, comprising:

a bobbin body having a first bobbin end and a second bobbin end spaced from the first bobbin end, the bobbin body including a winding surface between the first and second bobbin ends;

an axial passage defined through the bobbin body between the first and second bobbin ends, the bobbin body including an inner passage surface substantially facing the axial passage;

a first core member positioned at least partially in the axial passage;

a second core member positioned at least partially in the axial passage, an axial air gap defined between the first and second core members in the axial passage, the air gap having an axial gap distance, the air gap located at an air gap position within the axial passage; and a step having an outer step surface protruding from the winding surface between the first and second bobbin ends at a step position substantially aligned with the air gap position, the step having a step height defined as the distance between the local inner passage surface and the local outer step surface, wherein the step height is equal to or greater than the axial gap distance, wherein:

the step has an axial width defined as the width of the step in the longitudinal direction between the first and second bobbin ends, and the axial width is greater than twice the axial gap distance.

11. The apparatus of claim 10, wherein the step height is substantially equal to the axial gap distance.

12. A magnetic component apparatus for use in an electronic circuit, comprising:

a bobbin body having a first bobbin end and a second bobbin end spaced from the first bobbin end, the bobbin body including a winding surface between the first and second bobbin ends;

an axial passage defined through the bobbin body between the first and second bobbin ends, the bobbin body including an inner passage surface substantially facing the axial passage;

a first core member positioned at least partially in the axial passage;

a second core member positioned at least partially in the axial passage, an axial air gap defined between the first and second core members in the axial passage, the air gap having an axial gap distance, the air gap located at an air gap position within the axial passage; and a step having an outer step surface protruding from the winding surface between the first and second bobbin ends at a step position substantially aligned with the air gap position, the step having a step height defined as the distance between the local inner passage surface and the local outer step surface, wherein the step height is equal to or greater than the axial gap distance, wherein:

the step has an axial width defined as the width of the step in the longitudinal direction between the first and second bobbin ends, and the axial width is substantially equal to twice the axial gap distance.

13. The apparatus of claim 12, further comprising:

a first winding region defined between the first bobbin end and the step; and a first conductive winding disposed in the first winding region.

14. The apparatus of claim 12, further comprising:

a second winding region defined between the second bobbin end and the step; and a second conductive winding disposed in the second winding region.

15. The apparatus of claim 14, further comprising:

a third conductive winding disposed over all of the first conductive winding, the second conductive winding, and the step.

* * * * *